US007125290B2

(12) United States Patent
Martin et al.

(10) Patent No.: US 7,125,290 B2
(45) Date of Patent: Oct. 24, 2006

(54) CONNECTOR SYSTEM WITH POLARIZATION AND LATCHING FEATURES

(75) Inventors: Galen M Martin, Camp Hill, PA (US); Matthew F Foriska, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/091,558

(22) Filed: Mar. 28, 2005

(65) Prior Publication Data

US 2006/0217003 A1 Sep. 28, 2006

(51) Int. Cl.
*H01R 13/502* (2006.01)

(52) U.S. Cl. ..... 439/701

(58) Field of Classification Search ..... 439/701, 439/717, 540.1, 541.5, 595, 378, 380, 625
See application file for complete search history.

(56) References Cited

U.S. PATENT DOCUMENTS

| | | | | |
|---|---|---|---|---|
| 6,102,581 | A * | 8/2000 | Deveau et al. | 385/56 |
| 6,176,745 | B1 * | 1/2001 | Furutani | 439/701 |
| 6,309,242 | B1 * | 10/2001 | Ohtaka et al. | 439/489 |
| 6,315,619 | B1 * | 11/2001 | Nakamura | 439/701 |
| 6,352,444 | B1 * | 3/2002 | Yuzawa | 439/353 |
| 6,561,834 | B1 * | 5/2003 | Chen | 439/358 |

OTHER PUBLICATIONS

U.S. Appl. No. 10/856,298, filed May 25, 2004, Martin et al.

* cited by examiner

*Primary Examiner*—Alexander Gilman

(57) ABSTRACT

An electrical connector assembly includes an inner housing, where the inner housing includes a rib which is alignable with the slot in an outer housing to polarize the inner and outer housings together. The rib includes an interruption providing a gap in the rib defining a forward rib portion and an aft rib portion. Alternatively, the inner housing can be received directly in a mating low profile housing where a flexible arm containing an aperture is received over the forward rib portion to latch the two housings together.

11 Claims, 7 Drawing Sheets

CONNECTOR SYSTEM WITH POLARIZATION AND LATCHING FEATURES

BACKGROUND OF THE INVENTION

The subject invention relates to electrical connector assemblies having multiple profiles.

In many connector applications, a connector assembly includes multiple housing parts which includes an inner housing containing electrical contacts, and an outer housing receivable over the inner housing which may define the mating profile for the connector assembly, or may contain sealing functions or latching structures for the connector application.

In some such situations the outer housing is a large profile portion of the connector assembly and in other applications the outer housing is not used, in order to create a smaller or low profile connector housing. Thus, it would be advantageous if one inner housing, which contains the electrical contacts, could be used with both the outer, larger profile housing, and with the outer and low profile housing.

The objects of the invention are to overcome the shortcomings of the prior art.

SUMMARY OF THE INVENTION

The objects of the invention have been accomplished by providing an electrical connector assembly, comprised of an inner housing, comprising a rib positioned on an exterior of the inner housing. The rib can perform multiple functions. The rib can align the inner housing with an outer housing which is cooperable with the inner housing. The outer housing has a profile including a slot, whereby the rib is receivable therein to polarize the inner and outer housings. Additionally, the rib has a latching portion, whereby the latching portion is cooperably latched to a mating connector.

The rib may be elongate in the longitudinal direction, and may be interrupted along its length. The rib interruption may be defined as a gap intermediate the elongate rib, creating a forward and aft rib portion.

The latching profile on the mating connector housing may be profiled as a flexible arm, profiled for overlapping the rib. The flexible arm may have an aperture therethrough for overlapping the forward rib portion. The aperture may be spaced a linear length from a free end of the flexible arm, with the gap on the rib may be substantially equal to the linear length.

In another embodiment of the invention, an electrical connector housing comprises an inner housing comprising a rib positioned thereon, said rib defining an elongate aligning portion, and said rib defining a latching surface with a complementary latch.

The rib may be positioned on an exterior of said inner housing. The rib may be elongate in the longitudinal direction. The embodiment may further comprise an outer housing, profiled to include a slot, where the rib is receivable therein to polarize the inner and outer housings.

The rib may be interrupted along its length, where the rib interruption is defined as a gap intermediate the elongate rib, creating a forward and aft rib portion. The complementary latch may be profiled as a flexible arm, and the rib is profiled to receive the complementary latch in overlapping relation over the rib. The flexible arm has an aperture therethrough for overlapping the forward rib portion. The aperture may be spaced a linear length from a free end of the flexible arm.

The gap on the rib may be substantially equal to the linear length, such that the rib interruption receives a portion of the flexible arm therein.

In yet another embodiment of the invention, an electrical connector assembly, comprises a first housing portion, comprising a rib positioned thereon. A second housing portion is cooperable with the first housing portion, and the second housing portion has any one of a plurality of configurations, wherein the plurality of configurations include:

- a profile including a slot, whereby the rib is receivable therein to polarize the first and second housing portions; and
- a profile having a latching portion, whereby the latching portion is cooperably latched to said rib.

The second housing portion may be an outer housing portion attached to the first housing portion. Alternatively, the second housing portion may be a housing of a mating electrical connector housing.

BRIEF DESCRIPTION OF THE DRAWINGS

The invention will now be described by way of reference to the drawings where.

DESCRIPTION OF THE PREFERRED EMBODIMENT

Figure 1:
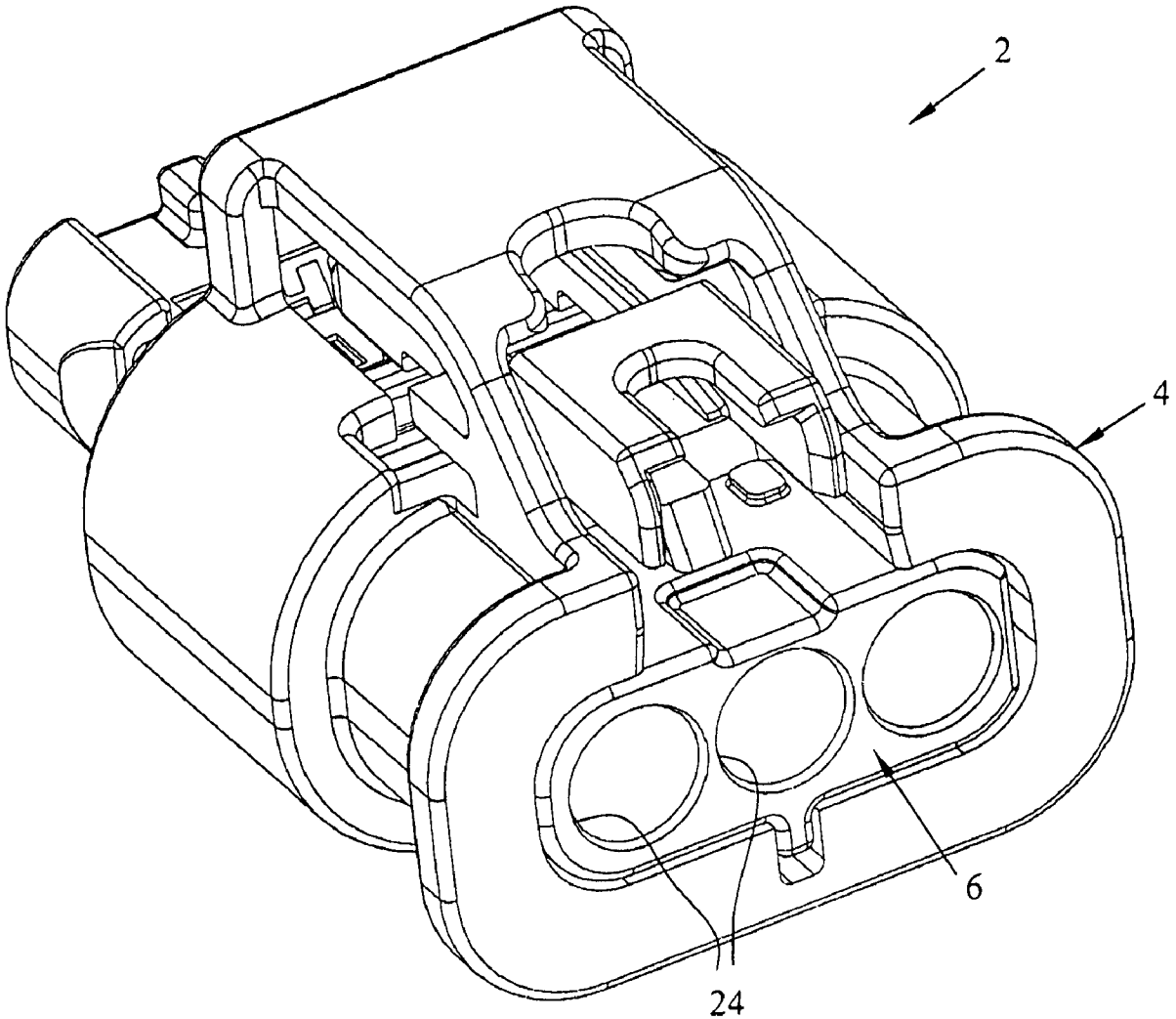
FIG. 1 is a rear perspective view of the connector assembly of the present invention.
Figure 2:
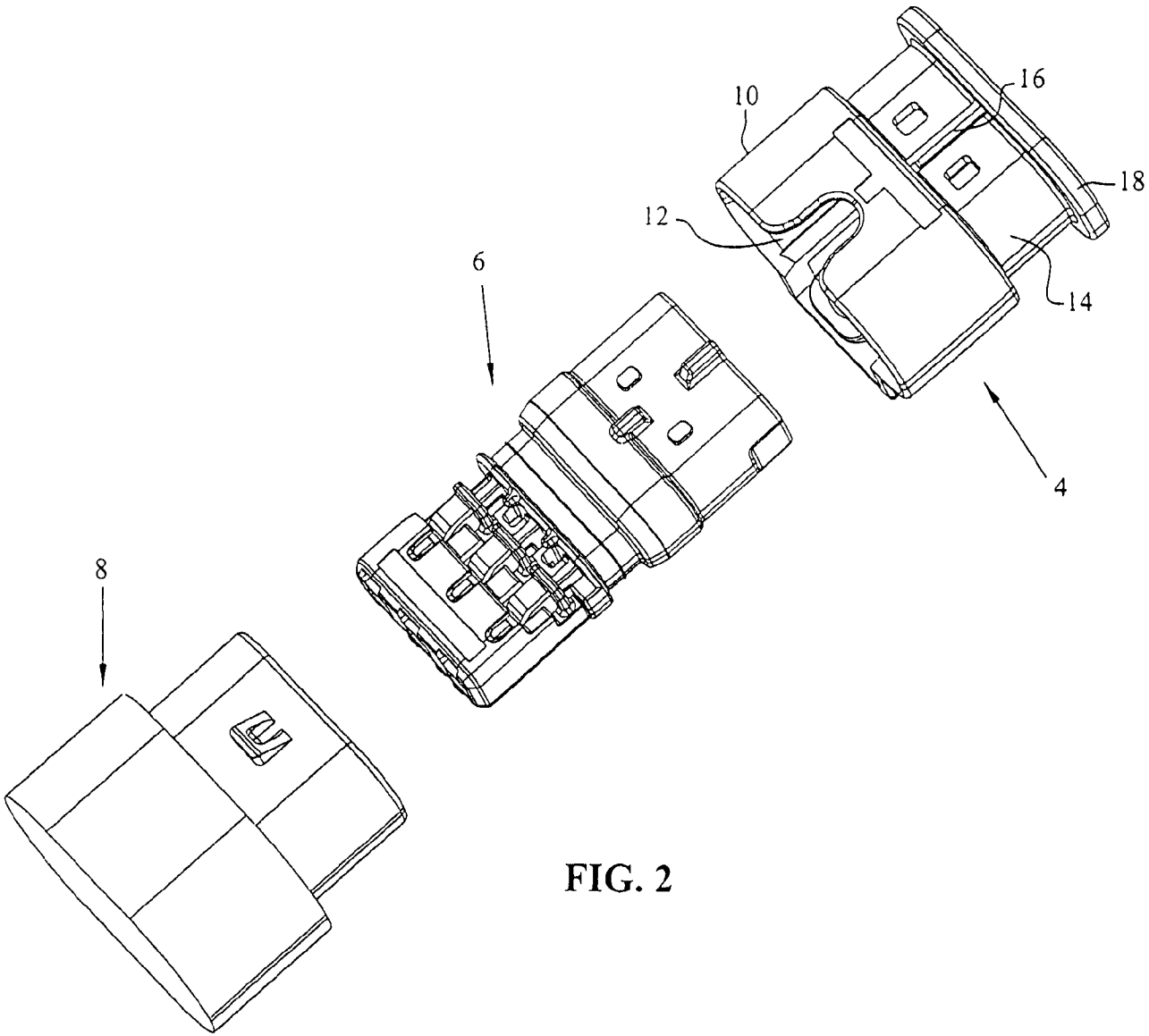
FIG. 2 is an exploded view of the connector assembly of FIG. 1 mated to a mating connector.

With reference first to FIG. 1, an electrical connector assembly is shown at 2 which includes an outer housing 4 and an inner housing 6. With reference now to FIG. 2, the connector inner housing 6 is shown exploded away from outer housing 4. FIG. 2 also shows a mating interface connector housing portion 8. As shown in FIG. 2, outer housing 4 includes a front shroud portion 10 which includes an opening 12 for receiving the inner housing 6. Outer housing 4 also includes an intermediate portion at 14 extending from the shroud 10 which includes a slot 16 which extends into and through the intermediate portion. Outer housing 4 also includes a rear plate portion 18 which defines a wire receiving face.

Figure 3:
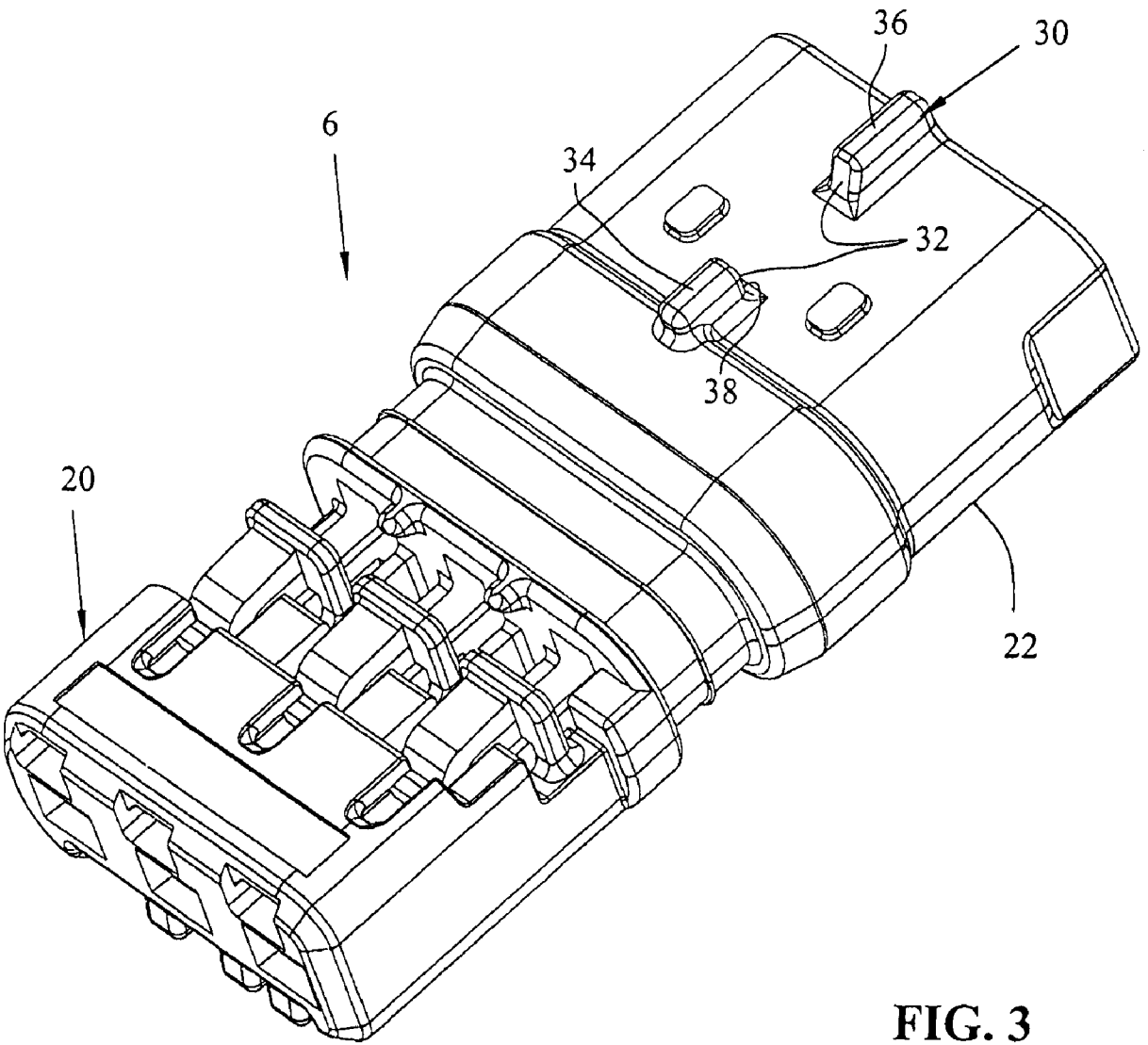
FIG. 3 is a front perspective view of the inner housing of the assembly of FIGS. 1 and 2.

As best shown in FIG. 3, inner housing 6 includes a front housing portion 20, which was more clearly defined in U.S. patent application Ser. No. 10/856,298 filed on May 25, 2004, the subject of which is incorporated herein by reference. Inner housing 6 further comprises a rear housing portion at 22 including wire receiving openings at 24 (FIG. 1) and where the rear housing portion 22 is profiled for receipt within shroud 10 of outer housing 4.

As best shown in FIG. 3, inner housing 6 includes a rib at 30 on an exterior of the inner housing 6 and which extends in a longitudinal direction. Inner housing 6 further defines an interruption at 32, defining a forward rib portion 34 and a rearward or aft rib portion 36. As will be more clearly described herein, interruption 32 defines a gap between the forward 34 and aft 36 rib portions, as well as a latching surface 38 on forward rib portion 34.

Figure 4:
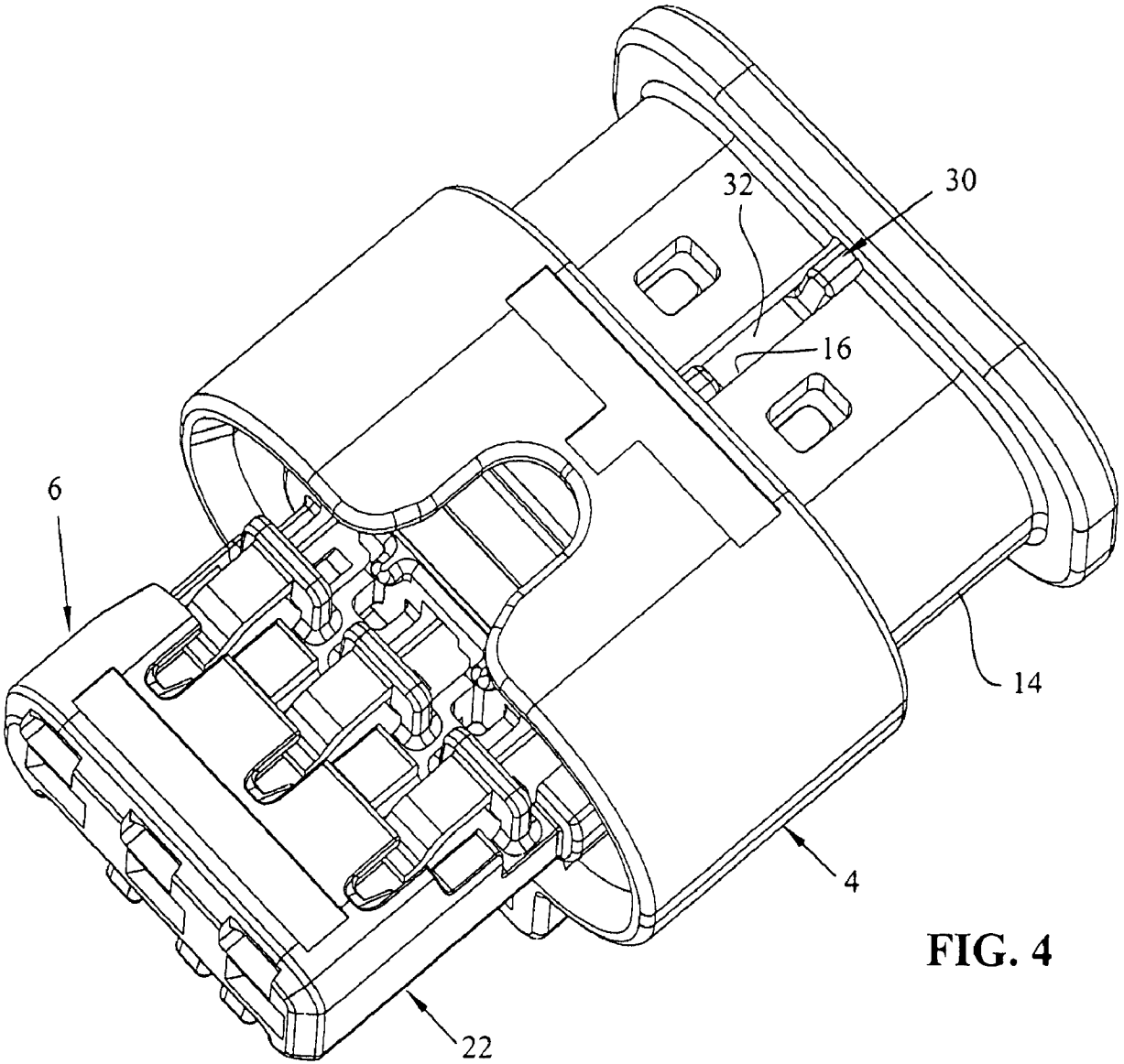
FIG. 4 is a view similar to that of FIG. 1 from the opposite perspective.

Thus in one embodiment of the invention, inner housing 6 is receivable into outer housing 4 with rib 30 providing an alignment feature or polarization feature enabling inner housing 6 to be positioned in outer housing 4 in a polarized manner. This assembly is shown in FIG. 4 where rib 30 is shown fully received and seated in slot 14. It should be appreciated that mating interface connector housing 8 (FIG. 1) could now be mated to inner housing 6 and outer housing 4.

Figure 5:
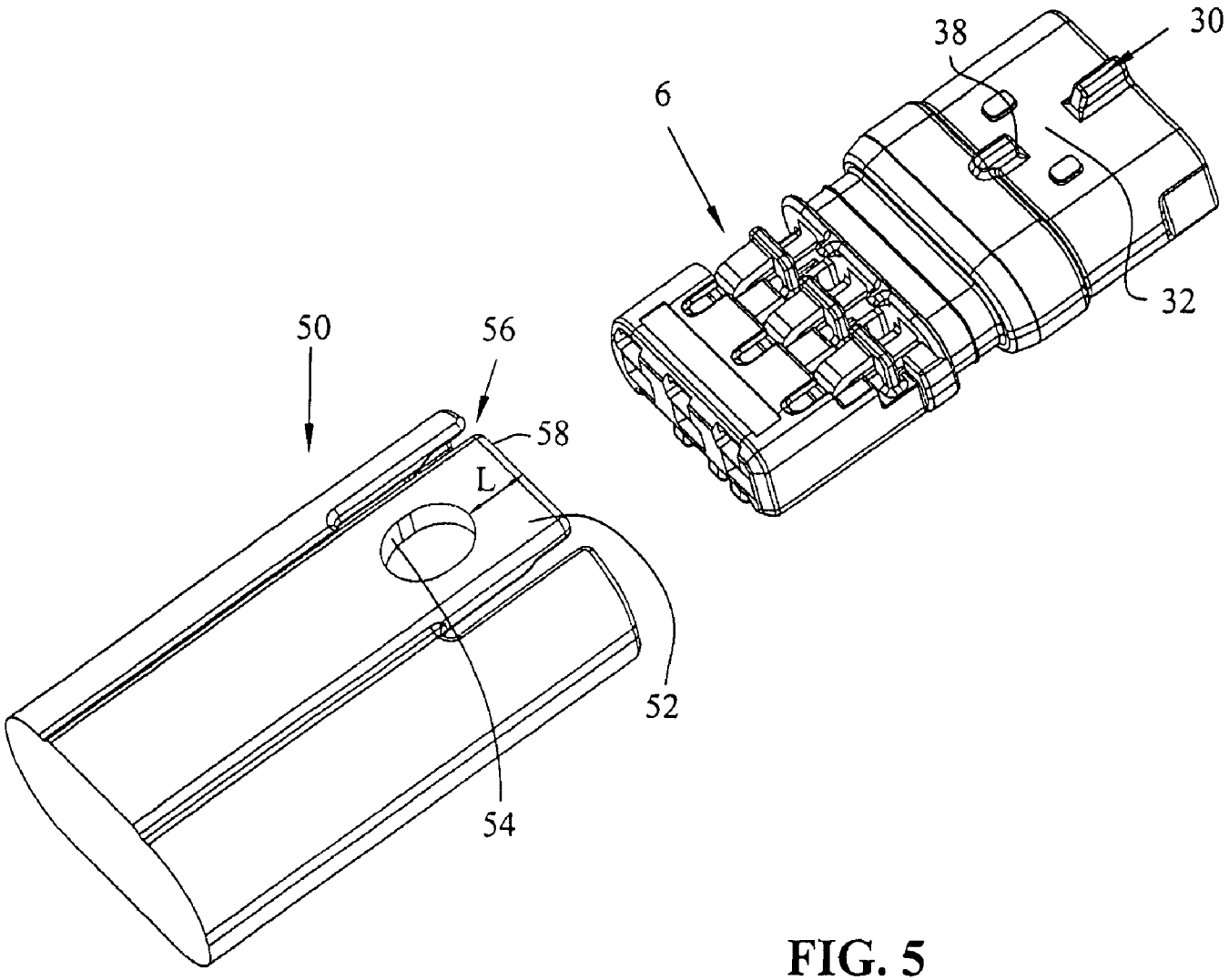
FIG. 5 is a view showing the inner housing of the embodiment of FIGS. 1 through 4 with a low profile mating connector housing.

With reference now to FIG. 5, inner housing 6 is shown with a low profile mating housing 50. Low profile mating housing 50 includes a flexible arm 52 having an aperture at 54, which as will be shown herein, defines a latching structure. Low profile mating housing 50 also has an inner volume at 56 which is profiled to receive inner housing 6 therein. With reference still to FIG. 5, aperture 54 is spaced a linear length L from a free-end 58 of flexible arm 52, and where linear length L is substantially equal to a length of the gap between forward 34 and aft 36 rib portions.

Figure 6:
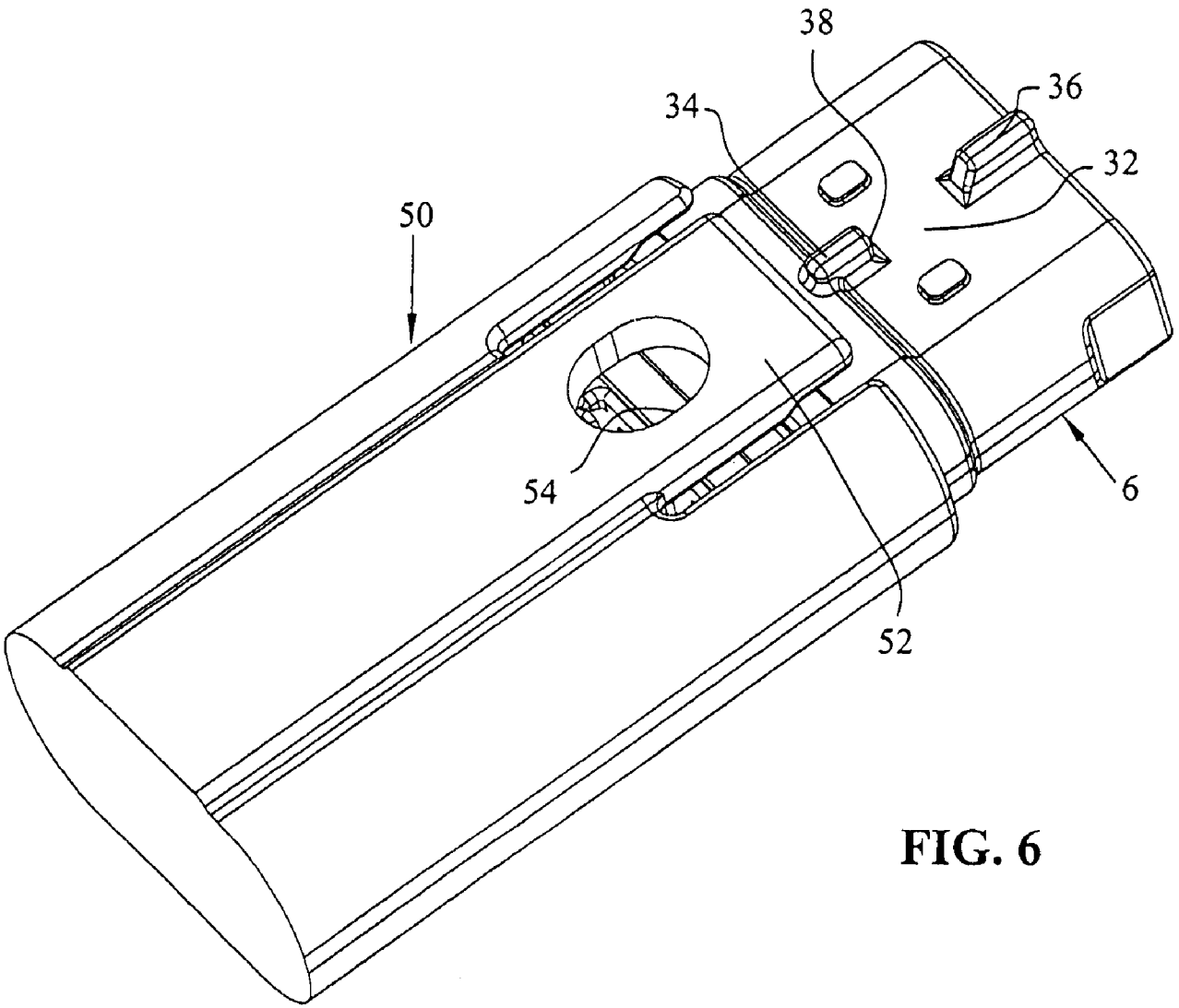
FIG. 6 shows the inner housing and low profile mating housing of FIG. 5 in a partially assembled position.
Figure 7:
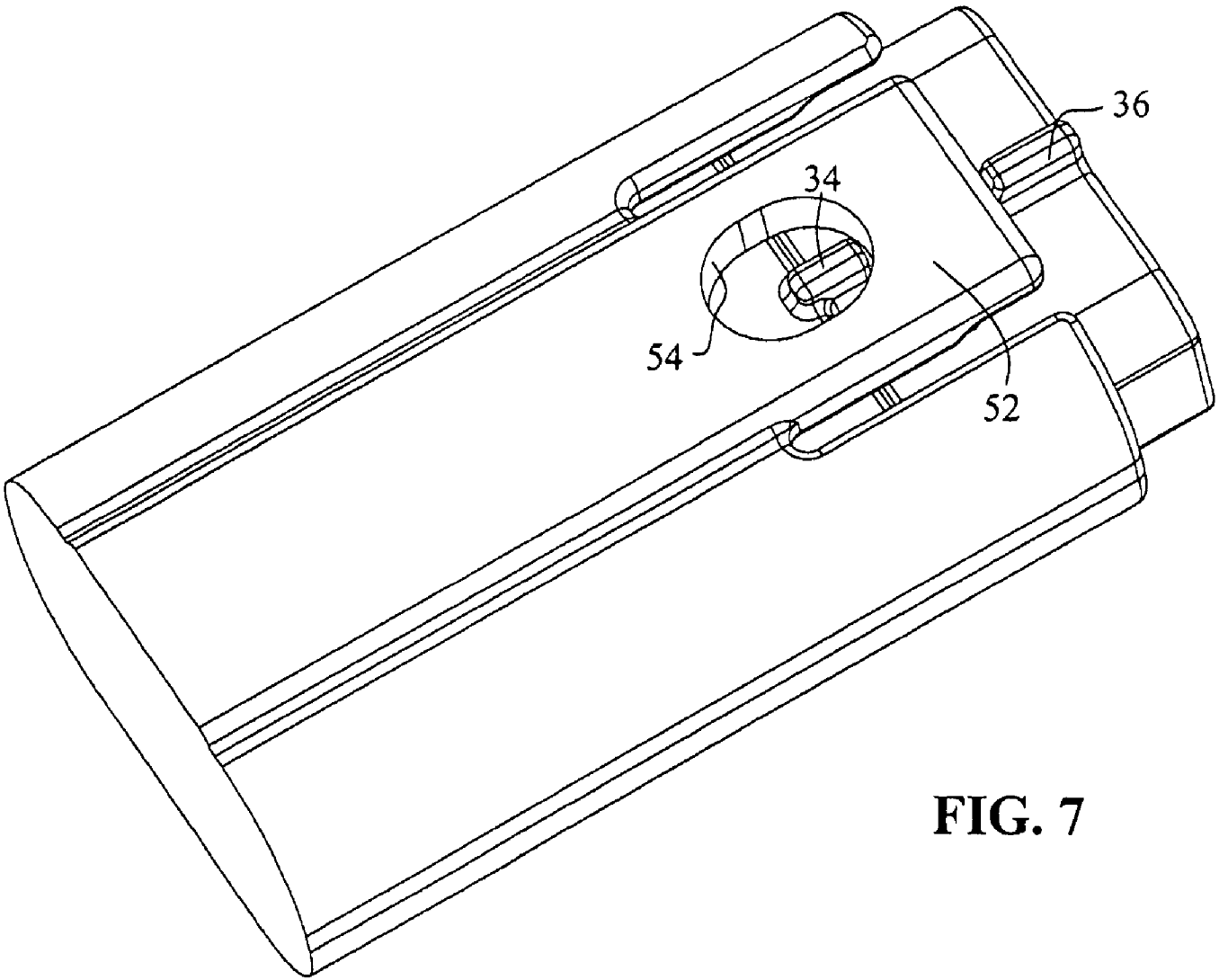
FIG. 7 shows the connector housings of FIG. 5 or 6 in a fully assembled position.

Thus with reference to FIG. 6, inner housing 6 is slidably receivable within low profile mating housing 50 to a position where forward rib portion 34 is aligned with aperture 54. As shown in FIG. 7, forward rib portion 34 is received under flexible arm 52 to a latched position within aperture 54. Thus as shown in FIG. 7, aperture 54 overlaps forward rib portion 34 as the gap formed by the interruption 32 is substantially the same as linear length L, and is therefore locked against latching surface 38.

Advantageously then, rib 30, due to its design with interruption 32 can be alternatively used as a polarizing rib with an outer housing having a slot to receive rib 30, or due to its interruption can be used in a low profile configuration without outer housing and be connected directly to making low profile housing 50. In this configuration, flexible arm 52 is receivable into the interruption 32 with aperture 54 encompassing forward rib portion 32 to latch the inner 6 and outer 4 housings together. As shown in FIG. 7, aperture 54 is latched against surface 38 of forward rib portion 34.

What is claimed is:

1. An electrical connector assembly, comprising an inner housing, said inner housing comprising a rib positioned on an exterior thereof and being elongate in the longitudinal direction, wherein said rib can perform multiple functions; wherein said rib can align the inner housing with an outer housing being cooperable with said inner housing, where the outer housing has a profile including a slot, said rib being interrupted along its length to define a gap intermediate said elongate rib, creating a forward and aft rib portion, whereby said rib is receivable therein to polarize said inner and outer housings; and said rib has a latching portion, whereby said latching portion can be cooperably latched to a mating connector.

2. The electrical connector of claim 1, wherein said latching profile on the mating connector housing is profiled as a flexible arm, profiled for overlapping said rib.

3. The electrical connector of claim 2, wherein the flexible arm has an aperture there through for overlapping said forward rib portion.

4. The electrical connector of claim 3, wherein the aperture is spaced a linear length from a free end of said flexible arm.

5. The electrical connector of claim 4, wherein said gap on said rib is substantially equal to the linear length.

6. An electrical connector housing, comprising an inner housing and an outer housing, said inner housing comprising a rib positioned on an exterior thereof, said rib defining an elongate and rigid aligning portion, and said rib defining a latching surface with a complementary latch, said rib being interrupted intermediate its length, said outer housing profiled to include a slot, whereby said rib is receivable therein to polarize said inner and outer housings.

7. The electrical connector of claim 6, wherein said rib interruption is defined as a gap intermediate said elongate rib, creating a forward and aft rib portion.

8. The electrical connector of claim 7, wherein the complementary latch is profiled as a flexible arm, and said rib is profiled to receive the complementary latch in an overlapping relations over said rib.

9. The electrical connector of claim 8, wherein the flexible arm has an aperture therethrough for overlapping said forward rib portion.

10. The electrical connector of claim 9, wherein the aperture is spaced a linear length from a free end of said flexible arm.

11. The electrical connector of claim 10, wherein said gap on said rib is substantially equal to the linear length, such that the rib interruption receives a portion of the flexible arm therein.

* * * * *